US005205717A

United States Patent [19]

Tell

[11] Patent Number: 5,205,717

[45] Date of Patent: Apr. 27, 1993

[54] EJECTOR ARRAY AND A METHOD OF ACHIEVING IT

[75] Inventor: Peter Tell, Åkersberga, Sweden

[73] Assignee: Piab AB, Akersberga, Sweden

[21] Appl. No.: 960,881

[22] Filed: Oct. 14, 1992

[30] Foreign Application Priority Data

Oct. 31, 1991 [SE] Sweden ..... 9103237

[51] Int. Cl.[5] ..... F04F 5/48

[52] U.S. Cl. ..... 417/189; 417/187; 294/64.2

[58] Field of Search ..... 417/163, 182, 187, 189, 417/176; 294/64.2

[56] References Cited

U.S. PATENT DOCUMENTS

| | | | |
|---|---|---|---|
| 4,087,021 | 8/1987 | Ise et al. | 417/187 |
| 4,432,701 | 2/1984 | Ise | 294/64.2 |
| 4,466,778 | 8/1984 | Volkmann | 417/187 |
| 4,549,854 | 10/1985 | Yamamoto | 417/187 |
| 4,655,692 | 4/1987 | Ise | 417/187 |
| 4,880,358 | 11/1989 | Lasto | 417/182 |

*Primary Examiner*—Richard A. Bertsch
*Assistant Examiner*—Roland McAndrews
*Attorney, Agent, or Firm*—Young & Thompson

[57] ABSTRACT

Method of achieving with at least two compressed air operated ejectors a desired subpressure in the shortest possible time and with the least use of energy, this method including connection of the ejectors such that they work one at a time in response to which of them is supplied with compressed air. In turn, compressed air supply is controlled in respons to the subpressure in a subpressure collection chamber common for all ejectors. An ejector array (1) for the method includes at least two compressed air operated ejectors (2, 3) each having its own optimum efficiency at the same values of the supplied compressed air. A sensor is disposed for sensing the subpressure in the chamber (23), compressed air being supplied to one ejector (2, 3) at a time, in response to the sensed pressure in the chamber (23). Compressed air is first supplied to the ejector (2) evacuating the greatest amount of air per time unit, and last to the ejector (3) generating the lowest subpressure.

3 Claims, 2 Drawing Sheets

EJECTOR ARRAY AND A METHOD OF ACHIEVING IT

Figure 1:
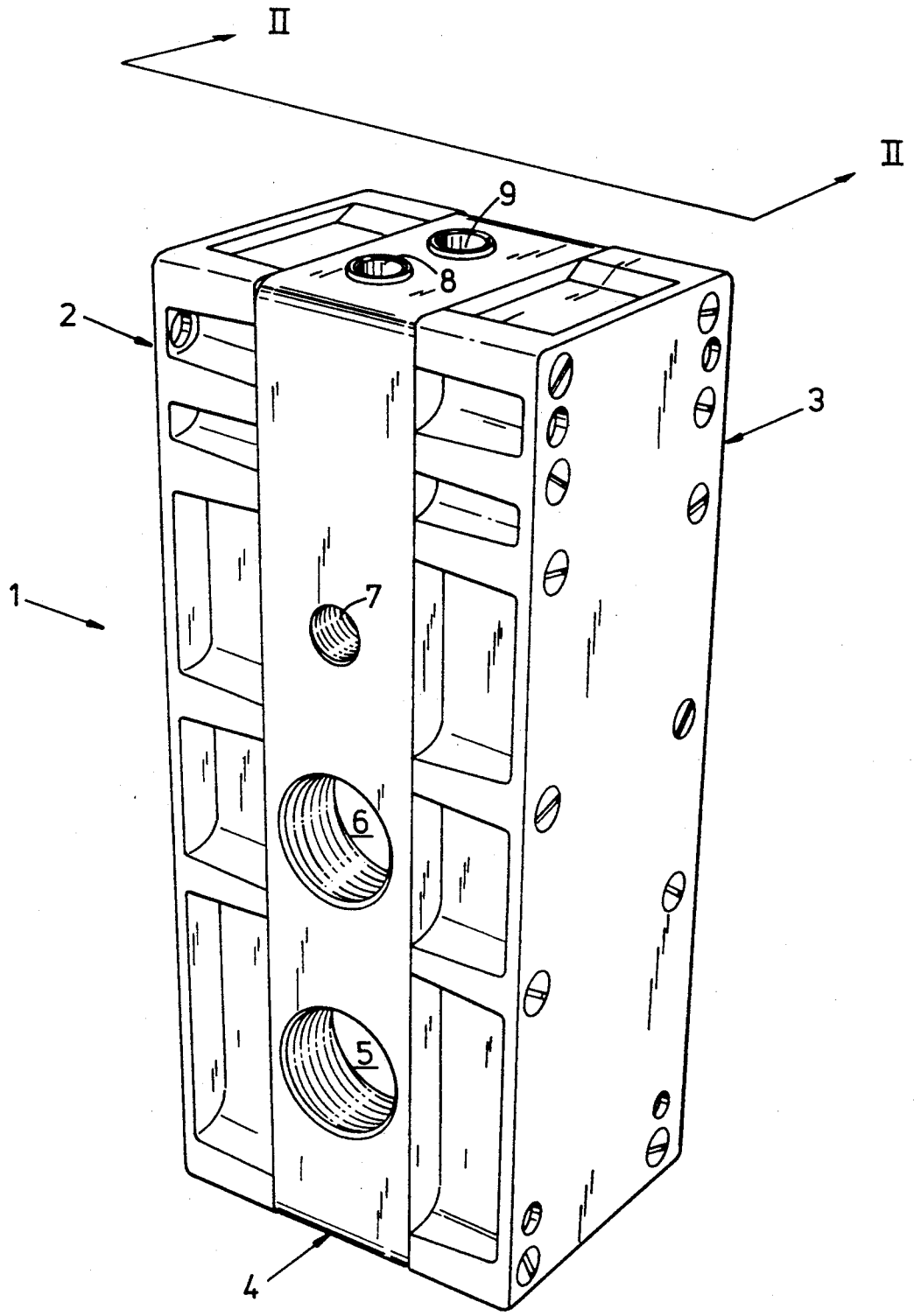

The present invention relates to ejectors and particularly to an ejector array including at least two ejectors, each of which is adapted for operating at its optimum efficiency, and which together form what may be called a combination ejector.

In accordance with the invention, such a combination ejector is primarily intended for being constructed from smaller ejectors, preferably so called multiejectors, i.e. ejectors of the type including several consecutively arranged ejector jets accomodated in the same ejector housing. However, the invention is not limited to such ejectors, and can be used with practically all types of ejector operating with pressurized air or other gas.

Subpressure is used in many fields, particularly for handling objects, e.g. gripping and retaining them during movement and machining in machine tools, picking them out in sorting operations, picking paper in printing and binding machines and the like. Irrespective of the field of use, it is known that the least losses in the use of energy, i.e. the best ratio between supplied compressed air and subpressure obtained, are obtained the closer to the point of operation that the ejectors can be placed, and it may be formed such as to be a part of the suction pad used for gripping the objects which are to be handled. Small, light multiejectors of the type which are apparent from the Swedish patent 8802143-1, for example have been developed for this purpose and can be placed on such as picking arms, manipulator arms and the like without incurring problems relating to weight and size. On most of these known multiejectors suction pads or other nozzles can be mounted directly on to them, and as already mentioned, they naturally give an optimum use of energy.

Ejectors of this kind are also implemented individually to have an optimum efficiency within given operational ranges. This means that the optimum efficiency extends between an implementation where the ejector has low capacity, i.e. it evacuates a small amount of air per time unit, but with great effect, i.e. it achieves an extremely low subpressure, to an implementation where the ejector has a high capacity, i.e. it evacuates a large amount of air per time unit, but has a low effect, i.e. it achieves a moderatly low subpressure. In other words, the ejectors are implemented to have a best efficiency in a desired combination of capacity and effect for a selected operational range and for a given compressed air supply.

In such applications where large and heavy loads are to be handled, e.g. in lifting or moving, relatively many and large suction pads are required for providing sufficient lifting power so that the load is reliably attached to the bodies during handling. This requires in turn that a large amount of air must be evacuated from the pads and also that a very low subpressure must be achieved at the pads. The shape of the load may also have importance for the configuration of the pads, and thus the amount of air which is to be evacuated from them, as well as the material in the load, which may be of a nature such that it permits a passage of a greater or less amount of air, which must be evacuated continuously during handling.

Taking into account that the ejectors, as mentioned, have different working characteristics, it is necessary in cases such as the ones mentioned above to choose ejectors that provide the sufficiently heavy subpressure and which can maintain it for the load in question to be retained with the aid of the suction pad or pads during handling. Ejectors providing the heavy subpressure then have low capacity and it thus takes a long time to reach the nescessary heavy subpressure at the pads. An increase of the available compressed air only gives a marginal improvement of capacity but a substantial increase in the amount of energy used for providing the compressed air. Ejectors having a high effect can not be selected since these do not give the necessary subpressure.

The compressor installation and operation of the compressor itself for providing the compressed air is the costly part of a compressed air operated vacuum system. For the best operational economy it is therefore a question of selecting a size of the compressor installation at a level suiting the application without unnecessary overdimensioning.

At the same time, suitable ejectors for the application in question must be selected. As mentioned above, there are no ejectors in the prior art which individually have the nescessary properties of rapid evacuation of a large amount of air and achieving a heavy subpressure. This situation thus requires a new ejector array for operation with a reasonable compressed air consumption without relinquishing the requirement of rapidity and efficiency of the means operating at subpressure, and the means can of course be other than suction pads.

The present invention has the object of eliminating the above mentioned problems by a new ejector array, a so-called combination ejector. This object us achieved by a method and an arrangement of the kind disclosed in the claims, which also disclose the distinguishing features of the invention.

Figure 2:
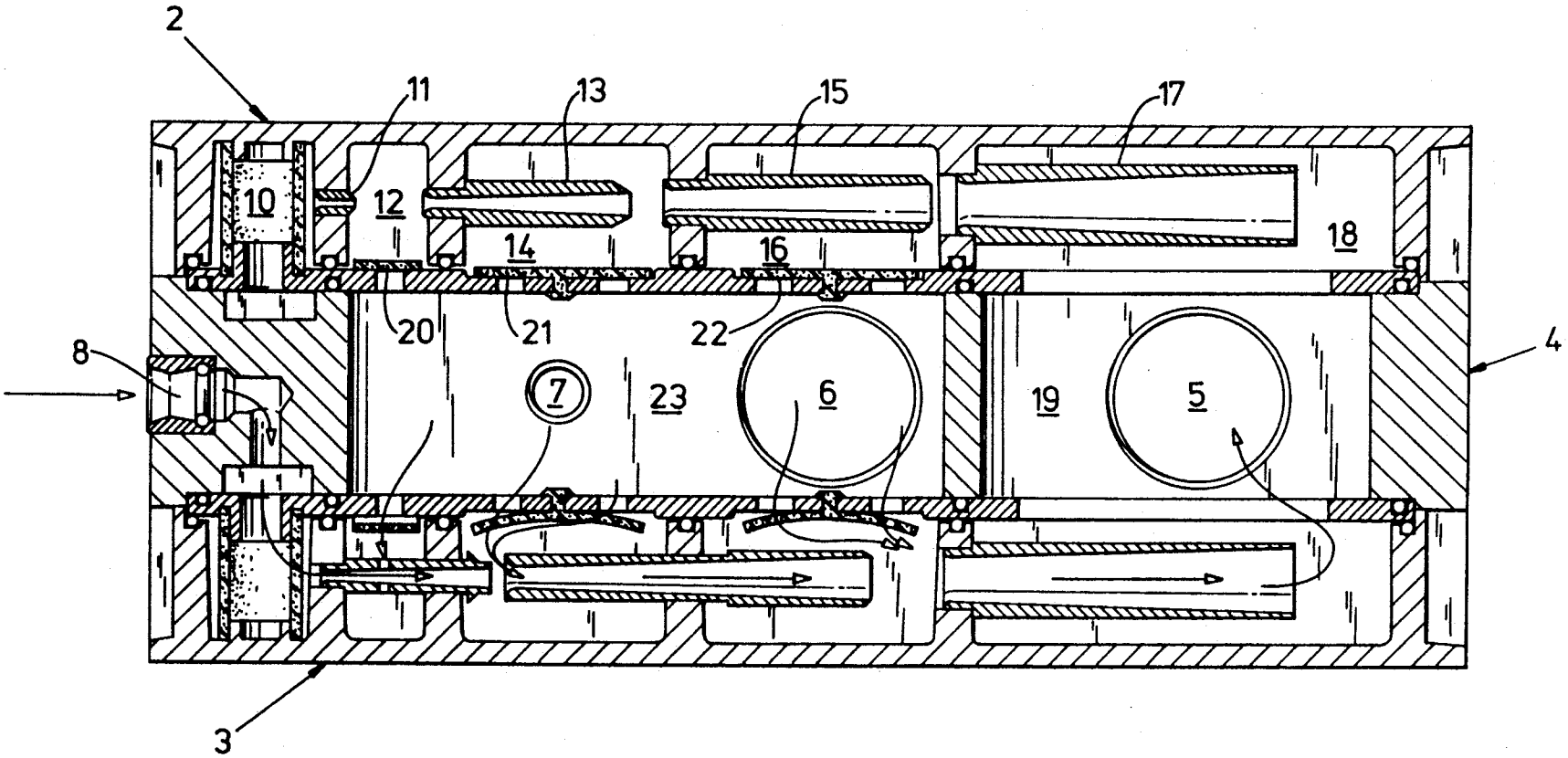

The invention will now be described in more detail in the following and in connection with the accompanying drawings, where FIG. 1 is a perspective view of an embodiment of a combination injector in accordance with the invention, and FIG. 2 is a section taken along the line II—II in FIG. 1.

The ejector array or combined ejector in FIG. 1, which has a generally box-shaped configuration, comprises two plate-shaped separate ejectors 2 and 3, fastened on either side of an intermediate member 4. The member 4 is provided with three openings: an outlet opening 5 for compressed air, a suction opening 6 for connection to a suction pad or the like, and an opening 7 for connection to a pressure transducer or other suitable means. In addition, the intermediate member 4 is provided at one short end with two openings 8, 9 for supplying compressed air to the ejectors 2 and 3 respectively.

The section of FIG. 2 schematically illustrates the internal configuration of the ejector array 1. The first ejector 2 is placed on one side of the intermediate member 4 and the second ejector 3 is placed on the other side. In the present case, the ejector 2 is the one which rapidly provides a vacuum amounting to between 50 and 40% of the ambient atmospheric pressure, and from this value the ejector 3 rapidly achieves a vacuum amounting to between 10 and 5% of the ambient atmospheric pressure. Neither these values nor the ejectors themselves constitute any part of the present invention, and therefore they will not be treated in detail.

When the ejector array 1 is put into operation, compressed air is first supplied through the connection 9, and is taken first through a chamber 10 and then through the jets 11, 13, 15, 17 for evacuating the chambers 12, 14, 16, beginning with the chamber 16 and terminating in the chamber 12. Compressed air is vented to atmosphere through the chambers 18 and 19 and the outlet 5. The chambers 12 and 16 are provided with non-return valves 20, 21, 22 permitting air to be exhausted from a subpressure collection chamber 23. This chamber 23 is provided with a suction opening 6, to which unillustrated operating means, e.g. suction pads, are connected.

A sensor is connected to the opening 7, this sensor in turn controlling the compressed air supply to the inlets 8 and 9. When the subpressure has reached a given value, e.g. 50% of the ambient atmospheric pressure, the compressed air supply is steered over to the second inlet 8, which means that the second ejector 3 comes into operation while the first ejector 2 ceases to operate. The non-return valves 20, 21, 22 prevent the possible flow of leakage air through the first ejector 2 to the subpressure collection chamber 23. The second ejector 3 has the same principle configuration as the first ejector 2, but has, for example, its best efficiency in the range between 50 and 5% of the ambient atmospheric pressure at the same values for the input compressed air as for the first ejector. Both ejectors 2, 3 are optimally suited in this array.

What is essential to the array is that only one ejector is working at one time. Actually, all the ejectors could be in operation at the same time, but those not operating in the pressure range prevailing, would then consume compressed air without supplying any notable amount of work. In the illustrated embodiment of the invention, the unillustrated compressed air switch is outside the combination ejector itself, but of course can be incorporated into it e.g. into the intermediate member or somewhere else in the array.

It will be understood that by this invention there is achieved an ejector array which is extremely effective and sparing of resources. It will be also understood that the array can include more than two ejectors, although in accordance with the invention the least number of ejectors is two. With the aid of the invention there has thus been achieved the object discussed in the introduction, namely the method of combining ejectors in an optimum way not previously utilised to obtain the best efficiency and least use of energy.

I claim:

1. Method of providing, with at least two compressed air-operated ejectors, a desired subpressure in the shortest possible time and with the least use of energy, characterised in that the ejectors used, which have optimum efficiencies within different working ranges for the same values of the supplied compressed air, are coupled together in a controlled manner such that the subpressure generated by the ejectors is present in a common sub-pressure collection chamber for supplying to means suitable for operation at subpressure, and such that the compressed air is taken to one ejector at a time in response to the subpressure in the subpressure collection chamber, starting with the ejector that evacuates the greatest amount of air per time unit, and finishing with the ejector generating the lowest subpressure.

2. Ejector array (1) including at least two compressed air operated ejectors (2, 3), characterised in that each ejector (2, 3) has its own optimum efficiency for the same values of the supplied compressed air, in that the ejectors (2, 3) are connected such that the subpressure generated by the ejectors (2, 3) is available in a common subpressure collection chamber (23), and in that in response to this sensed subpressure the sensor steers the compressed air supply to one ejector (2, 3) a time, the first ejector (2) to be supplied being the one evacuating the greatest amount of air per time unit, while the ejector (3) generating the lowest subpressure is supplied last.

3. Ejector array as claimed in claim 2, characterised in that the ejectors (2, 3) are mounted on a common intermediate member (4) accomodating the common subpressure collection chamber (23), and in that the ejectors (2, 3) are adapted for evacuating the air in the collection chamber (23) via non return valves (20, 21, 22) for preventing the passage of air to the chamber (23) via the ejectors (2, 3).

* * * * *